United States Patent [19]

Charbonnier et al.

[11] Patent Number: 4,595,893

[45] Date of Patent: Jun. 17, 1986

[54] MICROWAVE TRANSMISSION LINE ELEMENT COMPRISING ONE OR MORE INCORPORATED SWITCHING MEMBERS FOR INSERTING ONE OR MORE QUADRIPOLES

[75] Inventors: Roger Charbonnier, Meudon Bellevue; Joël Remy, Paris; Gérard Sauvage, Fontenay Le Fleury, all of France

[73] Assignee: Adret Electronique, France

[21] Appl. No.: 606,015

[22] Filed: May 2, 1984

[30] Foreign Application Priority Data

May 24, 1983 [FR] France ..... 83 08944
Jan. 31, 1984 [FR] France ..... 84 01442

[51] Int. Cl.[4] ..... H01P 1/10

[52] U.S. Cl. ..... 333/246; 200/153 S; 333/105; 333/81 A; 333/262

[58] Field of Search ..... 333/105, 262, 81 A, 333/101, 81 R, 246; 335/4, 5; 200/153 S

[56] References Cited

U.S. PATENT DOCUMENTS 3,014,187 12/1961 Sher et al. ..... 333/262 X
3,019,402 1/1962 Lanctot ..... 200/153 S X
3,666,902 5/1972 Owen et al. ..... 200/153 S
3,781,722 12/1973 Pierson ..... 333/81 A X

*Primary Examiner*—Paul Gensler
*Attorney, Agent, or Firm*—William A. Drucker

[57] ABSTRACT

A microwave coaxial switch has a central conductor which comprises two fixed segments connected by a movable segment, controlled by a switch member. The resilient ends of the fixed segments come into engagement with the contacts of a quadripole such as an attenuator cell, when they are freed from the movable segment, this latter having come into engagement with the ground conductor.

6 Claims, 8 Drawing Figures

MICROWAVE TRANSMISSION LINE ELEMENT COMPRISING ONE OR MORE INCORPORATED SWITCHING MEMBERS FOR INSERTING ONE OR MORE QUADRIPOLES

BACKGROUND OF THE INVENTION

1. Field of the Invention

It is often necessary to switchably insert one or more quadripoles in microwave transmission lines for modifying the transmission thereof.

One particularly advantageous application of the invention concerns the construction of a variable attenuator comprising several cells with graduated values. In other applications, amplifiers, filters or frequency changers will have to be switchably inserted in the line.

2. Description of the Prior Art

This problem is usually solved by means of switching members called "coaxial switches", although the line element which forms them is not necessarily coaxial. These switches generally have the disadvantage of using two mobile line segments which, depending on their position, provide direct transmission or transmission through the quadripole to be inserted.

They introduce a high insertion loss and have relatively poor isolation between the two transmission channels. In general, they are expensive and have a substantial electric energy consumption.

U.S. Pat. No. 3,319,194 describes a variable attenuator whose switching member is of the above mentioned type, with the particularity that it is formed by a micro strip line whose central conductor forms, at intervals, two parallel channels one of which provides direct transmission and the other transmission with attenuation, switching between the two channels being achieved by means of a flexible conducting segment movable from one channel to the other.

This construction provides good impedance continuity and a low insertion loss but has the disadvantage of forming a parasite passage channel at the terminals of each attenuation cell when this latter is switched.

Another disadvantage is that, since the contacts are switched for a relatively long time during switching, considerable intermediate attenuation is then obtained, which is undesirable for some applications.

3. Object of the Invention

It is an object of the present invention to provide a switchable transmission line element constructed according to the micro strip line technique, but free of the above mentioned disadvantages and particularly economical.

SUMMARY OF THE INVENTION

In accordance with a feature of the invention, there is provided a transmission line element comprising at least one ground conductor; another exposed conductor disposed in the vicinity of the ground conductor and parallel thereto, said other conductor comprising two fixed segments joined together by a mobile segment comprising flexible conducting blades; and means for moving the mobile segment so as to move it from a first position in which it connects the fixed segments together in a second position in which it permits connection of these fixed segments with conducting or insulating terminals, wherein said terminals are fixed and positioned so that their respective ends are situated opposite a predetermined surface portion of the respective ends of the fixed segments and so that, in the first position, the mobile segment engages the said face whereas, in the second position, the mobile segment is disengaged from the fixed segments while the ends of the fixed segments are freed and have come by resilient deformation into contact with said terminals.

BRIEF DESCRIPTION OF THE DRAWINGS

The different features, as well as the advantages of the invention, will be clear from the following description.

In the accompanying drawings.

DESCRIPTION OF THE PREFERRED EMBODIMENTS

Figure 1:
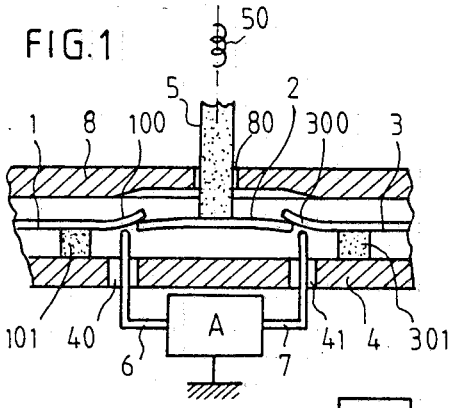
FIG. 1 is a view in partial longitudinal section of a switchable transmission line element according to an embodiment of the invention, shown in position of direct transmission.
Figure 2:
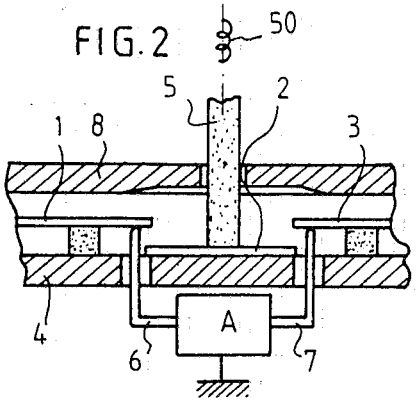
FIG. 2 shows the element of FIG. 1 in the switched position.

In FIGS. 1 and 2 is shown a three plate stripline element, comprising two ground planes 4 and 8 and three conducting segments 1-2-3 forming the intermediate plate. Segments 1 and 3, fixed to the ground plane 4 by dielectric blocks 101–301, are resilient and their respective ends 100–300 are pre-cambered downwardly Segment 2 is integral with an insulating rod 5 which passes through a guide orifice 80 formed in conductor 8 and whose movement, in a direction perpendicular to the planes of the conductors of the line, is controlled by means, known per se, shown symbolically by a coil 50. Of course these means may be of any appropriate type, manual, mechanical or electro-mechanical.

In the position of FIG. 1, segment 2 is in contact with the lower faces of ends 100 and 300, which are cambered upwards and out of contact with two contacts 6 and 7 of a quadripole A. Contacts 6 and 7 are themselves introduced, perpendicularly to the planes of conductors of the line, in orifices 40–41 formed in conductor 4 and positioned fixedly and accurately with respect to the line. In the position shown in FIG. 2, since rod 5 has been moved so as to bring the mobile segment 2 into contact with conductor 4, the ends 100 and 300, now freed, because of their resilience come into engagement with the ends of the respective contacts 6 and 7. It is clear that the position of the quadripole and the orientation of the contacts could be varied: for example, the quadripole could be placed between the central conductor and the ground conductor, the contacts then being inside the structure.

It is clear that, in FIG. 1, the quadripole A is not connected to the line, a direct transfer of the TEM wave then taking place along the line, which presents no appreciable discontinuity and has the desired characteristic impedance. The geometry and the dimensions of the elements are determined by a man skilled in the art so as to obtain the desired characteristics and so that the cut off frequency of the guide formed by the flat conductors 4 and 8 is appreciably greater than the range of the frequencies to be transmitted.

In the position of FIG. 2, quadripole A is inserted in the line: it will for example be an attenuator, an amplifier, a filter, a frequency changer or similar. It will be noted that line segment 2 cannot effect any parasite transmission because of its intimate contact with the ground plane 4.

When rod 5 is operated to make the quadripole inoperative, it is clear that the contact between ends 100–300 and the respective contacts 6 and 7 is only suppressed after segment 2 has moved said ends away from said contacts. In the inverse operation, contact between said ends and said contacts occurs before segment 2 has itself lost contact with said ends. There is in the end practically no break in the transmission during switching. The movement of segment 2 is moreover of a small amplitude, of the order of a millimeter for example.

Figure 3:
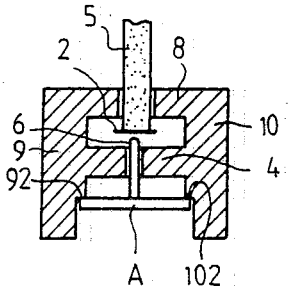
FIG. 3 is a view, in partial cross section, of a switchable transmission line element identical or similar to the one shown in FIGS. 1 and 2.

FIG. 3 shows, in cross section a practical embodiment of the device: the ground conductors 4 and 8 are here joined together by lateral walls 9–10 which are extended so as to form an appropriate receptacle for quadripole A. This latter is, by way of example, an attenuation cell of the hybrid circuit type, which is positioned in the receptacle by means of two shoulders 92–102 formed in the extensions of walls 9–10. The ground contacts of this cell are connected to the ground of the transmission line.

Figure 7:
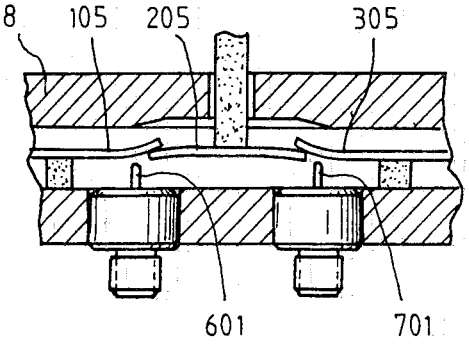
FIG. 7 shows a switchable line element having two coaxial plugs.

It will be noted that in a modified embodiment (FIG. 7) quadripole A could be connected to the line by means of coaxial plugs whose central conductors 601–701 would form contacts 6 and 7. With this solution a frequency changer device may for example be inserted in the line.

Figure 4:
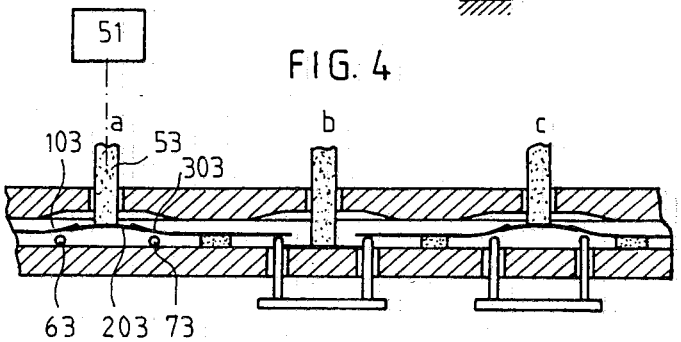
FIG. 4 shows a multiple switching line element.

In FIG. 4, a transmission line has been shown in which are incorporated several switching members of the above described type. The first one a forms a protection switch: when the ends of the conducting sections 103–303 are freed by the corresponding mobile segment 203, they come to rest against insulating stops 63–73. By way of variant, stop 63 could be replaced by a contact connected to a load adapted for dissipating the reflected power.

Blade 51 symbolizes an electronic means for controlling switching off; this means will cause rod 53 to move so as to switch off the transmission should an accidental reflection of power be detected.

The second and third switching members b and c allow the attenuation cells to be switched in or out for example, so as to form a microwave attenuator. In the positions shown, cell b is operative and cell c is inoperative.

Figure 5:
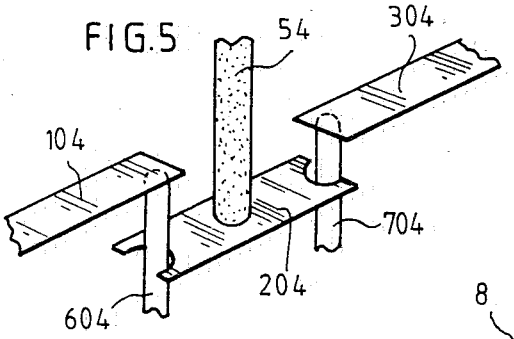
FIGS. 5 and 6 show, respectively in perspective and in a top view, a preferred embodiment of a switching assembly intended to be incorporated in such a line element.
Figure 6:
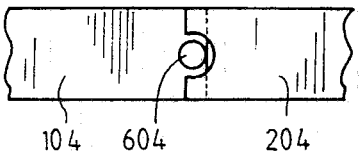

In FIGS. 5 and 6, a mobile segment 204 has been shown having at each end a notch, advantageously semi-circular, in which the fixed contacts 604 and 704 pass.

Engagement of these fixed contacts with blades 104 and 304 takes place practically at the edge of said blades, as shown in FIG. 6: thus discontinuities are avoided in the line which would increase the standing wave rate in direct transmission.

It will be noted that, in the devices described, contact always takes place, in whichever position, on the same face of the resilient segments 1–3; 104–304, which appreciably reduces the discontinuities which occur at the time of switching.

It goes without saying that the invention is not limited to the arrangements described and shown. It will be noted that a line element comprising a switching member, such as the one shown in FIG. 7, could have a coaxial input and a coaxial output for connection thereof to coaxial transmission lines. The device thus formed would play the conventional role of "transfer relay" while presenting, with respect thereto, a number of advantages: in the direct passage position, no short circuit of the quadripole; the number of successive contacts reduced in a ratio of two; a single mobile element instead of 4.

The transmission element which has just been described has the important advantage of comprising only a single mobile element per switching member.

By forming programmable attenuators in accordance with the preceding description excellent characteristics up to a few GHz may be obtained, but when the number of quadripoles to be switched is high (greater than 3 or 4), the regular arrangement of the supports causes periodic mismatching to occur which affects the transmission when the incident frequency corresponds to a wave length $\lambda$ equal to twice the pitch of this periodic mismatching. So as to avoid any transmission defect in a band from 0 to 30 GHz, that would lead in practice to forming a line having a mismatching pitch of 5 mm at most, which is difficult to achieve in practice.

Another disadvantage of the devices described comes from the use of flexible blades which may have mechanical resonance modes if the device is subjected to vibrations.

Figure 8:
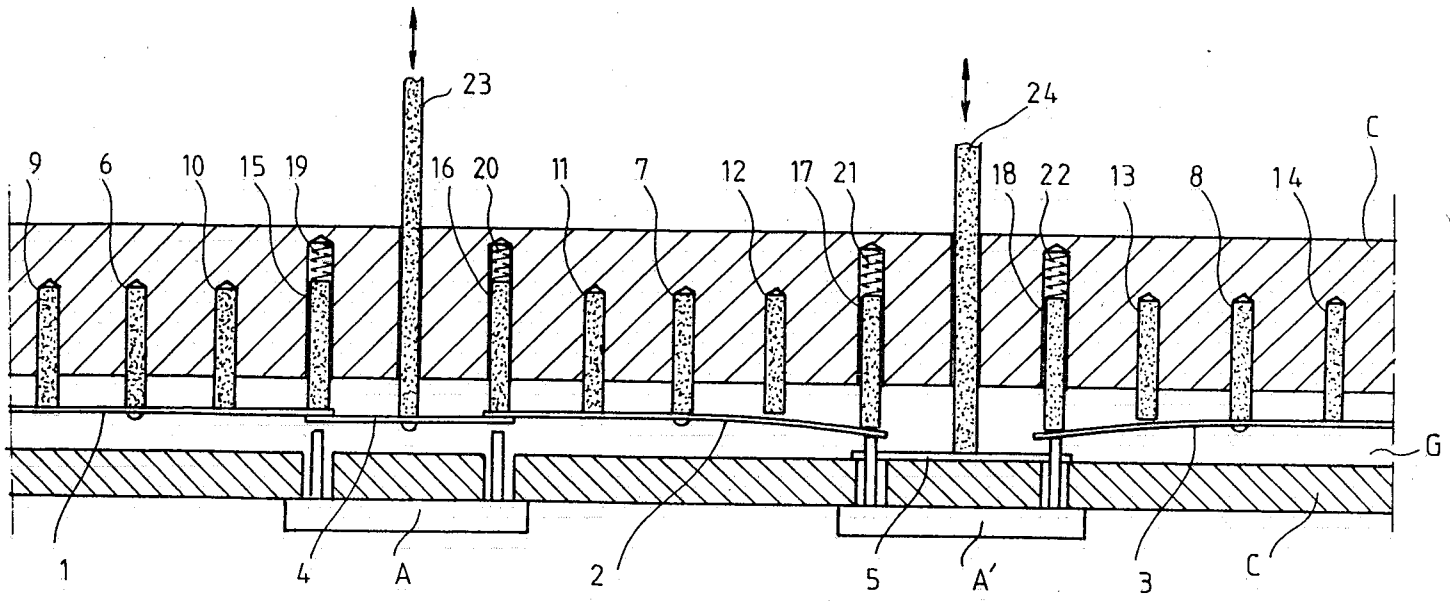
FIG. 8 shows in longitudinal section a programmable attenuator adapted to be formed with a high number of cells and to operate at frequencies at several tens of GHz.

To avoid the problem of transmission defects due to the supports up to several tens of GHz and so as to remove the risk of resonance of the blades in a harsh mechanical environment, in the device of FIG. 8 each of the fixed segments is supported by two or more fixed insulating supports and mobile insulating push rods are provided which come to bear against the ends of the fixed segments.

The attenuator of FIG. 8 comprises a plurality of attenuation cells only two of which A and A′ have been shown. Only cell A′ is inserted in the line in the example shown.

As in the attenuator shown in FIG. 4, the device comprises fixed line segments referenced 1, 2 and 3, mobile segments 4 and 5 actuated by control members 23 and 24 and insulating supports for the fixed line 6, 7 and 8. The device further comprises additional fixed insulating supports 9, 10, 11, 12, 13 and 14 which are flush with the fixed segments and mobile insulating push rods 15, 16, 17 and 18 free to move in blind holes 19 to 22 bored in the body C of the attenuator and urged towards the line by calibrated springs.

The purpose of the additional fixed supports and of the mobile push rods is first of all to reduce the mechanical pitch of the support structure, so that the inevitable mismatching due to holding the line in position by means of material supports has a periodicity such that its effect is transferred beyond the useful frequency band.

With respect to the arrangement of the preceding Figures, said pitch, for the same dimension of the elements to be inserted, is divided by three, which triples the frequency band covered without transmission accident.

It will be noted that, for an incident frequency of $30\times10^9$ Hz, which corresponds to a wave length in an air line$=3.10^8/30.10.^9=0.01$ m, it is sufficient to obtain a pitch less than or equal to half this wave length, namely 5 mm, which is easy to obtain with the technique described.

Another advantage of the device of FIG. 8 is an improved behavior of the line, because of the additional supports and especially because of the fact that the mobile push rods 17 and 18, when quadripole A' is inserted, nip the lines and apply them against the contacts of said quadripole A'.

The mechanical resonances of the fixed flexible blades are thus very much attenuated and their effects are suppressed because of the nipping of the contacts.

Calibration of the springs for the push rods allows the pressure of the contacts to be perfectly controlled both in the work and rest positions.

What is claimed is:

1. A microwave transmission line element comprising:

(i) first and second ground conductors;

(ii) a base conductor disposed between the said ground conductors and parallel thereto, said base conductor comprising first and second fixed segments having respective resiliently deformable ends and a mobile segment;

(iii) means for moving said mobile segment within the space defined by the said ground conductors from a first position in which it connects the resiliently deformable ends of the said first and second fixed segments together to a second position in which it is disengaged from the said resiliently deformable ends and in engagement with the first ground conductor;

(iv) first and second insulating stops having respective ends located opposite predetermined surface portions of the said respective resiliently deformable ends, said predetermined surface portions facing the first ground conductor, and the said mobile segment, engaging, in the first position, the said predetermined surface portions, while, in the second position of the mobile segment, the said predetermined surface portions are freed and have come respectively into contact with said first and second insulating stops by resilient deformation, whereas the first and second fixed segments are unconnected; and (v) a device adapted to detect an overload in the transmission line element and to control said means for moving said mobile segment.

2. A microwave transmission line element comprising:

(i) first and second ground conductors parallel to each other, said first ground conductor being traversed by two passages axed perpendicularly to said ground conductor and said second ground conductor being traversed by a guiding orifice axed perpendicularly to said ground conductors;

(ii) a base conductor disposed between the said ground conductors and parallel thereto, said base conductor comprising first and second fixed segments having resiliently deformable ends and a mobile segment which comprises first and second ends, said fixed and mobile segments each being constituted by flexible conductive blades;

(iii) means for moving said mobile segment within the space defined by the said ground conductors from a first position in which it connects the resiliently deformable end of the said first and second fixed segments together to a second position in which it is disengaged from the resiliently deformable ends and in engagement with the first ground conductor;

(iv) first and second fixed terminals having respective ends located opposite predetermined surface portions of the said respective resiliently deformable ends and in the immediate vicinity of said resiliently deformable ends, said predetermined surface portions facing the first ground conductor, and the said mobile segment, in its first position, engaging the said predetermined surface portion, while, in the second position of the mobile segment, the said predetermined surface portions are freed and have come respectively into contact with said first and second terminals by resilient deformation, wherein said first and second ends of said mobile segment have indentations through which respectively pass the said terminals.

3. A microwave transmission line element comprising:

(i) first and second plane ground conductors parallel to each other and delimiting therebetween an inner volume, said first ground conductor being traversed by two passages axed perpendicularly to said ground conductors and said second ground conductor being traversed by at least a guiding orifice axed perpendicularly to said ground conductors;

(ii) a base conductor disposed between the said ground conductors and parallel thereto, said base conductor comprising first and second fixed segments having respective resiliently deformable ends separated by a non conductive zone of the inner volume, and a mobile segment, said fixed and mobile segments each being constituted by flexible conductive blades;

(iii) means for moving said mobile segment within the said inner volume from a first position in which it connects the resiliently deformable end of the said first and second fixed segments together to a second position in which it is disengaged from the said resiliently deformable ends and in engagement with the first ground conductor, said means comprising a movable rod, fixed to said mobile segment and passing through said guiding orifice;

(iv) first and second fixed conductive terminals extending parallel to said movable rod and each passing through a corresponding passage and having an inner and an outer end, the respective inner end of said conductive terminals being located in the said volume opposite to predetermined surface portions of the said respective deformable ends, said predetermined surface portions facing the first ground conductor and the said mobile segment, in a first position engaging the said predetermined surface portions, while, in the second position of the mobile segment, the said predetermined surface portions are freed and have come respectively into contact with said inner ends of the first and second conductive terminals by resilient deformation;

(v) insulating means provided between said conductive terminals and their respective passages;

(vi) an exterior electric circuit connected to the outer end of said conductive terminals.

4. The transmission line element as claimed in claim 3 wherein said two ground conductors are joined together by lateral walls which are outwardly extended by legs formed so as to constitute a receptacle for positioning a quadripole which is connected to said terminals.

5. The transmission line element as claimed in claim 3, wherein said terminals are formed by central conductors of coaxial studs engaged in said passages.

6. A microwave transmission line element comprising:

(i) first and second ground conductors parallel to each other, said first ground conductor being traversed by two passages axed perpendicularly to said ground conductor and said second ground conductor being traversed by a guiding orifice axed perpendicularly to said ground conductors and further comprising first and second blind holes respectively located on both sides of said guiding orifice;

(ii) a base conductor disposed between the said ground conductors and parallel thereto, said base conductor comprising first and second fixed segments having resiliently deformable ends and a mobile segment said fixed and mobile segments each being constituted by flexible conductive blades;

(iii) means for moving said mobile segment within the space defined by the said ground conductors from a first position in which it connects the resiliently deformable end of the said first and second fixed segments together to a second position in which it is disengaged from the resiliently deformable ends and in engagement with the first ground conductor;

(iv) first and second fixed terminals having respective ends located opposite predetermined surface portions of the said respective resiliently deformable ends, said predetermined surface portions facing the first ground conductor, and the said mobile segment, in its first position, engaging the said predetermined surface portion, while, in the second position of the mobile segment, the said predetermined surface portions are freed and have come respectively into contact with said first and second terminals by resilient deformation, wherein said means for moving the mobile segment comprise an insulating push rod slidably mounted in said guiding orifice and integrally connected to the said mobile segment, the said transmission line element comprising first and second further insulating push rods freely movable in said first and second blind holes and respectively urged by first and second springs against the resiliently deformable ends of the first and second fixed segment respectively.

* * * * *